United States Patent [19]

Chance et al.

[11] 4,384,412

[45] May 24, 1983

[54] DRYER DRUM SIPHON

[75] Inventors: James L. Chance, Rockton, Ill.; Gregory L. Wedel, Beloit, Wis.; Edgar J. Justus, Beloit, Wis.; Ronald D. Cooke, Beloit, Wis.

[73] Assignee: Beloit Corporation, Beloit, Wis.

[21] Appl. No.: 255,774

[22] Filed: Apr. 20, 1981

[51] Int. Cl.[3] ..... F26B 13/08

[52] U.S. Cl. ..... 34/119; 34/125

[58] Field of Search ..... 34/119, 124, 125; 165/86, 87, 88, 89

[56] References Cited

U.S. PATENT DOCUMENTS

| | | | |
|---|---|---|---|
| 661,353 | 11/1900 | Moore et al. . | |
| 1,095,757 | 5/1914 | Wentz . | |
| 2,892,264 | 6/1959 | Armstrong | 34/125 |
| 2,993,282 | 7/1961 | Daane et al. | 34/125 |
| 3,034,225 | 5/1962 | Hieronymus | 34/125 |
| 3,242,583 | 3/1966 | Calkins | 34/18 |
| 3,264,754 | 8/1966 | Kutchera | 34/124 |
| 3,276,141 | 10/1966 | Barnscheidt et al. | 34/125 |
| 3,640,000 | 2/1972 | Lee et al. | 34/125 |

OTHER PUBLICATIONS

PCT/US80/00329, Oct. 16, 1980, Steffero.

*Primary Examiner*—Larry I. Schwartz

*Attorney, Agent, or Firm*—Hill, Van Santen, Steadman, Chiara & Simpson

[57] ABSTRACT

A steam heated dryer drum for use in a papermaking machine with the drum including a cylindrical rotary hollow drum shell and a structure for removing condensate from the steam from the shell including a conduit leading from inside to outside the shell and an improved structure for receiving the condensate with a siphon tip having a hollow chamber within and an opening facing the inner surface of the dryer shell and closely spaced thereto and a flange at the lead end of the siphon tip with an inclined ram surface and a wall across the center of the chamber in engagement with the inner surface of the shell.

7 Claims, 3 Drawing Figures

DRYER DRUM SIPHON

BACKGROUND OF THE INVENTION

The invention relates to improvements in paper machine dryer drums, and more particularly to an improved condensate removal system with a siphon tip capable of removing a thin layer of rimming condensate and condensate which gathers in a puddle.

In a papermaking machine after the web is dewatered and pressed, it is passed to the dryer section which conventionally embodies a plurality of cast iron steam heated rotating dryer cylinders. Steam enters each of these dryers and condenses as it transfers heat to the dryer shell, and the dryer shell in turn transfers heat to the paper causing the moisture in the paper to evaporate. It is essential to producing a satisfactory paper sheet that the dryer drum transfer heat efficiently and uniformly to the sheet, and it is essential to satisfactory and economical operation that effective and efficient heat transfer occur from the steam in the drum to the shell. A large factor in controlling and attaining effective heat transfer is the removal of the condensate within the drum. This condensate may be ponding, cascading or rimming, and the state of the condensate depends upon a number of factors, but the siphon assembly which is provided to remove the condensate must be capable of satisfactory removal whether the condensate is ponding, cascading or rimming.

When the condensate is rimming, the heat must be transferred through it, and this is a thermal problem. The thicker the condensate layer, the higher the thermal resistance. When the condensate is not rimming, the problem becomes a mechanical one, and if the condensate layer becomes too large, it takes longer to speed up, and the drive loads increase and the drive torque becomes erratic which has a deleterious effect on the quality of the paper being manufactured. Therefore, it is important to minimize the amount of condensate in the dryer drum at all times.

It is, therefore, an important object of the present invention to provide an improved dryer drum and siphon condensate removal system which minimizes the amount of condensate in the drum at all times and is capable of handling the condensate whether it be ponding, cascading or rimming.

In general in present commercial dryers, the steam enters the dryer drum often through a backside journal, and the condensate is evacuated through a frontside journal along with some uncondensed steam which is termed blow-through. The components of the siphon assembly are the siphon shoe or tip which is usually positioned adjacent the inner surface of the shell, the radial pipe through which the condensate flows after it is picked up by the shoe, the siphon elbow which turns the flow of condensate to a horizontal direction, the horizontal pipe, and the rotary steam fit. These items make up the dryer siphon assembly and are each important, but a salient feature of the instant invention is the design of the shoe or tip which is capable of effective removal of the condensate and a thorough and a more complete removal of condensate for the conservation of energy and the production of a better paper web.

The achieving of a structure which can operate with a thinner layer of condensate will reduce the insulating effect of the condensate. It has been found that the condensate depth decreases consistently with decreasing clearance between a siphon shoe or tip to a point of approximately 0.060". Once that point has been reached, the condensate cannot be reduced in thickness by any further reduction in siphon clearance, and this feature is taken into consideration in connection with the design of the siphon tip of the instant invention.

As stated above, the condensate may take different forms in either cascading, puddling or rimming, and it is well known as recited in White, R. E. "Residual Condensate, Condensate Behavior, and Siphoning in Paper Driers", TAPPI, Vol. 39, No. 4, Apr. 1956, p. 228–233, that at lower dryer speeds, condensate which is still in the dryer drum will form a puddle in the bottom of the dryer. At slightly higher speeds, this condensate starts to climb the wall of the dryer shell and then cascade back into the puddle. An excessive amount of condensate cascading off the dryer wall will produce a large and erratic drive load. At higher speeds, the condensate forms a thin circumferential layer on the inside dryer surface, and this layer acts as a thermal insulator. Under these rimming conditions, an excessive amount of condensate in the dryer will produce an excessive thermal resistance. To avoid both of these operating conditions, the amount of condensate in the dryer must be kept at a minimum, and in accordance with the features of the present invention, the design of the siphon tip greatly influences the value of this minimum. During nonrimming conditions, the siphon tip will evacuate condensate only when it is submerged in the condensate puddle, that is, when the siphon tip is in the region where it projects downwardly so as to be in the puddle. During the rest of the cycle, the siphon tip is exposed only to the steam which is under pressure in the drum and hence only blow-through steam is being evacuated, rather than condensate.

In order to evacuate as much condensate as possible during the time the siphon tip is submerged, conventionally siphon tips have heretofore been designed for nonrimming conditions and have a large spacing between the siphon tip and the dryer shell, or a large opening in the bottom of the siphon tip. With this construction and the use of a large opening, the blow-through flow rate of steam is excessive when the siphon tip is not submerged. Further, the amount of condensate in the dryer is very large during high speed rimming operation.

In accordance with the features of the present invention, the foregoing problems are minimized by the design of the siphon tip such that a relatively small spacing, optimally less than 0.08" is provided between the siphon tip and the inner surface of the dryer shell. It has been discussed that the spacing has an effect on the thickness of the layer of rimming condensate by Calkins, D. L., "The Effects of Siphon Clearance on Dryer Performance", The Johnson Corporation, Three Rivers, Michigan, 1966. The small spacing in conventional designs, however, has a disadvantage of providing a very poor nonrimming performance. It has been found that in order to evacuate condensate at a rate of 3,250 lb/hr, and keep the puddle depth less than 8", the pressure differential across the siphon assembly must be in excess of 7.0 psi. This produces a blow-through flow rate in excess of 450 lb/hr.

A further feature of the invention substantially improves the condensate removal performance in that the profile of the edge of the siphon tip which first contacts the condensate puddle is uniquely constructed. This edge slopes in an angular face toward the inner surface of the shell and has a large projected opening which is tapered down to a small siphon tip to dryer shell spacing. The angle of the ram face which faces in the direction of rotation of the dryer should be in the range of 10° to 45° and of a height which is preferably in the range of 0.2" to 1.0". This leading edge acts as a channel which forces the condensate into the small opening and has a ram effect greatly enhancing the nonrimming performance of the siphon which is mounted very close to the dryer shell. It has been found that this type of siphon can evacuate condensate at a rate of 3,250 lb/hr and keep the puddle depth to less than 4" with a pressure differential across the siphon assembly at only 6.5 psi which produces a blow-through flow rate of only 400 lb/hr.

A further feature of the invention is to provide a siphon tip with a center enlarged chamber portion. This chamber has an axially extending partition dividing the chamber into trailing and leading edge chamber portions. The partition provides a better surface on which to rest the siphon tip and also provides a wall to keep the condensate which enters the siphon tip from the leading side from flowing through the siphon tip and out the trailing edge.

A further object of the invention is to provide an improved siphon tip of a design which is structually efficient to manufacture and which is capable of the improved removal of condensate from a steam dryer drum.

Other objects, advantages and features will become more apparent with the teaching of the principles and concepts of the invention in connection with the description of the preferred embodiment in the specification, claims and drawings, in which:

DRAWINGS

DESCRIPTION OF THE PREFERRED EMBODIMENTS

Figure 1:
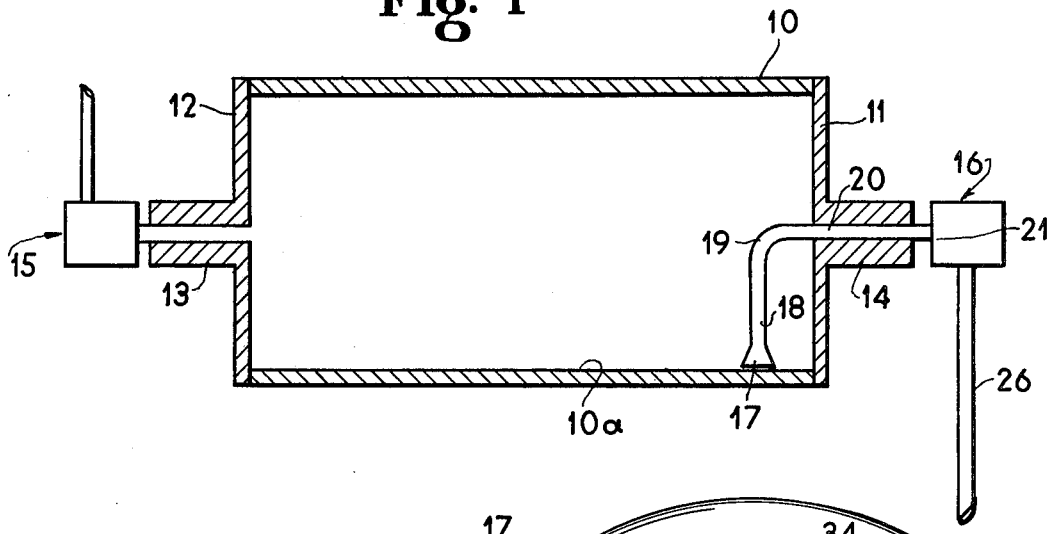
FIG. 1 is a somewhat schematic vertical sectional view taken through a dryer drum assembly.

As illustrated in FIG. 1, a hollow cylindrical rotary steam dryer drum assembly is shown with a hollow annular shell 10 having a smooth outer surface for contacting a paper web and a smooth inner cylindrical surface 10*a*. The shell is supported on heads 11 and 12 which have rotation supporting hubs 13 and 14 which are shown somewhat schematically but are provided with detailed bearings and drives as will be known to those versed in the art.

For heating the shell 10 to paper web drying temperature, steam is directed to the interior of the drum through a supply conduit 15.

At the other supporting hub 14, a condensate removal conduit means is provided which includes a siphon tip 17 (which will be shown and described in greater detail in FIGS. 2 and 3), a radial conduit 18, an elbow or bend 19, an axially extending pipe 20 and a rotary steam fit joint 21. The joint provides a suitable connection within a construction housing 16 leading to a condensate and steam blow-through line 26.

Figure 2:
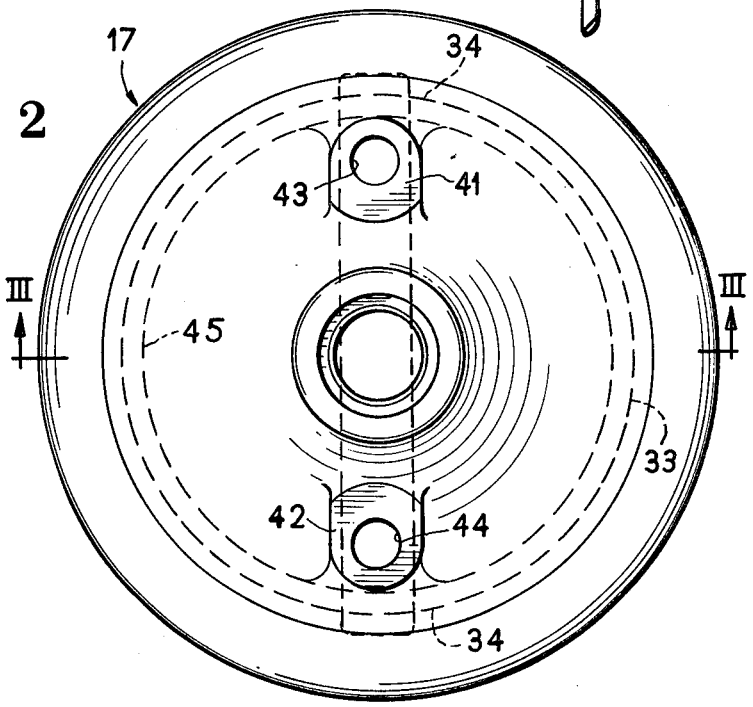
FIG. 2 is an enlarged plan view of a siphon tip construction embodying the principles of the present invention.
Figure 3:
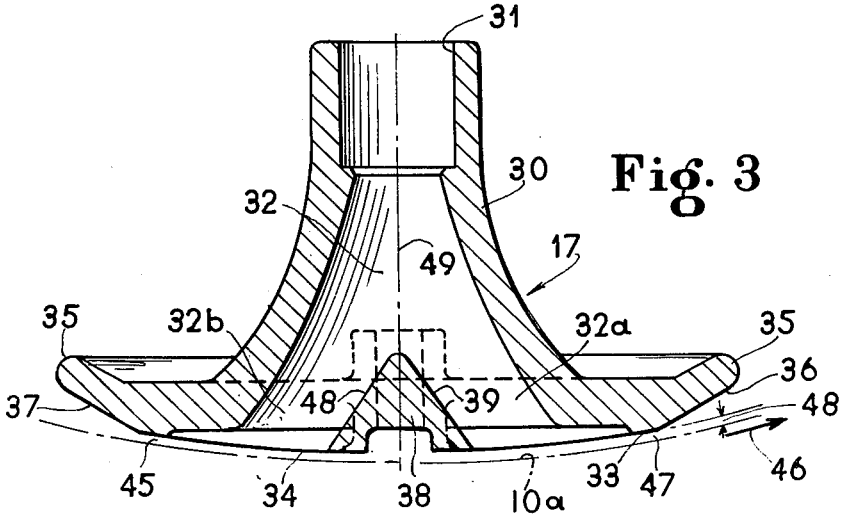
FIG. 3 is a vertical sectional view taken substantially along line III—III of FIG. 2.

The siphon tip 17, which is shown in greater detail in FIGS. 2 and 3, is preferably constructed in the form of a casting which provides a housing 30. At the upper or radial inner end of the housing 30 of the siphon tip is a socket 31 to connect to the radial pipe 18 of the condensate removal system.

The housing is somewhat bell shaped having an inner chamber 32 which flares outwardly in a direction toward the inner surface 10*a* of the shell.

At the edge of the housing 30 is a flange 35 which extends annularly around the housing and the flange is so constructed so as to provide a leading edge 36 which is inclined toward the inner surface 10*a* of the shell and faces in the direction of rotation of the drum which direction is indicated by the arrowed line 46. This construction provides a ram effect so that rimming condensate on the inner surface 10*a* of the shell is caught by the leading edge and forced into a narrow gap 47 at the trailing edge of the leading edge or surface 36. The gap 47 is maintained small in construction and as indicated by the dimension lines, the dimension 48, which represents the distance of the gap is 0.08" or less. The gap is defined by an annular ridge 33. The ridge is swung on an arc so as to be essentially parallel to the inner surface of the shell and provide a uniform gap around the annular ridge.

The housing 30 is constructed so as to be symmetrical about a center line 49 shown at the center of FIG. 3. Thus, a gap 45 is located at the trailing edge of the siphon tip which gap is similar to the gap 47 at the leading edge.

Extending in an axial direction across the center of the chamber 32 is a wall 38. This wall rests against the inner surface 10*a* of the shell and divides the chamber 32 into a fore and aft portion respectively 32*a* and 32*b*. The wall 38 has sloping surfaces 39 and 49 so as to provide channels which lead upwardly into the chamber 32 of the siphon tip. The wall 38 may be formed of a separate piece which is held in place in the housing 30 by bolts which extend through holes 43 and 44 in the wall 38 and through holes in bosses 41 and 42 in the housing 30.

In operation as the dryer shell rotates in the direction indicated by the arrowed line 46 in FIG. 3, condensate is forced beneath the leading edge 36 down into the narrow gap 47 to be carried into the chamber 32 of the housing 30. The condensate then passes up into the radial pipe 18, FIG. 1. The narrow gap 47 prevents any substantial blow-by of steam when the condensate is formed in puddles rather than rimming to line the inner surface 10*a* and also coacts with the leading inclined edge 36 to form a throat to receive the condensate by virtue of the ram effect which occurs both with condensate which is rimming or which forms a puddle or which cascades within the drum. It is contemplated that the housing 30 may be provided with a closed back portion instead of a gap as shown at 45 in which case the wall 38 need not be included. With the structural arrangement, the dryer drum can be rotated in either direction or the siphon tip may be installed in the position shown or rotated 180° inasmuch as it is symmetrical about the center line 49, FIG. 3. The sloping surface 39 of the wall aids in guiding the condensate which is passed through the gap 47 up into the chamber 32 and into the radial pipe 18.

The siphon tip construction produces superior performance characteristics in a wide range of speeds in which the dryer may be operated whether the condensate be in a rimming or a nonrimming condition. All operating conditions are taken advantage of with an optimum effective removal of condensate and without the disadvantages of excessive steam blow-by.

We claim as our invention:

1. A paper machine drying mechanism comprising in combination:

a rotary annular hollow cylindrical dryer drum shell having means for delivering steam to the interior for heating the outer drum surface to dry a paper web in contact with said outer surface;

a condensate siphon conduit means leading from the interior of the drum to the exterior thereof for removing condensate and having a portion extending coaxially outwardly and having a radial portion leading from the axial center toward the inner surface of the shell;

and a siphon tip connected to said radial portion having a bell shaped housing with a flaring outer wall defining a chamber therein and with an outer flange edge having a surface facing toward the shell to force condensate beneath the tip into said chamber by a ram effect, the tip having an annular edge surrounding the chamber in close proximity to the inner surface of the shell but spaced uniformly from the shell and sufficiently for condensate to pass thereunder into the chamber, said tip being annular in shaped with an annular flange and said chamber being circular in shape.

2. A paper machine dryer mechanism constructed in accordance with claim 1:

and an axially extending wall extending across said chamber and projecting radially inwardly into the chamber with a space above the wall.

3. A paper machine dryer mechanism constructed in accordance with claim 2:

wherein said wall extends axially across the chamber to join the flange and has inclined sides angled upwardly to direct the flow of condensate into the chamber.

4. A paper machine dryer mechanism constructed in accordance with claim 3:

wherein said edge is constructed so as to be essentially concentric with the inner surface of the dryer drum shell.

5. A paper machine dryer mechanism comprising in combination:

a rotary annular hollow cylindrical dryer drum shell having means for delivering steam to the interior for heating the outer drum surface to dry a paper web in contact with the outer surface;

a condensate siphon conduit means leading from the interior of the drum to the exterior thereof for removing condensate forming on the inner surface of the shell;

a circular siphon tip connected to the inlet end of the conduit means for receiving condensate from the inner surface of said shell so that the condensate is removed and flows through the conduit means, said tip having a chamber therein with an opening facing the inner surface of the shell with the opening having a base edge in close proximity to the shell;

a flange surrounding the siphon tip providing an edge on the base inclined angularly toward the inner surface of the shell to form a ram effect for condensate flowing into said chamber;

and an axially extending wall extending across the chamber in contact with the inner surface of the shell and being of a radial height less than said chamber.

6. A paper machine dryer mechanism comprising in combination:

a rotary annular hollow cylindrical dryer drum shell having means for delivering steam to the interior for heating the outer drum surface to dry a paper web in contact with the outer surface;

a condensate siphon conduit means leading from the interior of the drum to the exterior thereof for removing condensate forming on the inner surface of the shell;

and a circular siphon tip connected to the inlet end of the conduit means for receiving condensate from the inner surface of said shell so that the condensate is removed and flows through the conduit means, said tip having an inlet opening defined in a base of the tip, said tip having an annular edge in the base surrounding the opening with the space between the edge and the inner surface of the shell being no greater than 0.08".

7. A paper machine dryer mechanism comprising in combination:

a rotary annular hollow cylindrical dryer drum shell having means for delivering steam to the interior for heating the outer drum surface to dry a paper web in contact with the outer surface;

a condensate siphon conduit means leading from the interior of the drum to the exterior thereof for removing condensate forming on the inner surface of the shell;

and a siphon tip connected to the inlet end of the conduit means for receiving condensate from the inner surface of said shell so that the condensate is removed and flows through the conduit means, said tip having an inlet opening defined in a base of the tip, the tip having a leading edge facing in the direction of shell rotation which edge inclines angularly toward the inner surface of the shell forming an angle with the shell between 10° and 45° so that the condensate is carried beneath said edge with a ram effect into the tip opening, and said tip including an axially extending wall element within the inlet opening dividing said opening into a fore and aft portion with said wall element resting against the inner surface of the shell.

* * * * *